US006112961A

United States Patent [19]

Phillips

[11] Patent Number: 6,112,961

[45] Date of Patent: Sep. 5, 2000

[54] MULTIPLE PURPOSE ANKLE POUCH

[75] Inventor: Selina M. Phillips, 48971 Denton Rd., Belleville, Mich. 48111

[73] Assignee: Selina M. Phillips, Belleville, Mich.

[21] Appl. No.: 08/940,742

[22] Filed: Sep. 30, 1997

[51] Int. Cl.[7] ..... A45C 13/30

[52] U.S. Cl. ..... 224/222; 224/219; 602/27; 2/311; 150/131

[58] Field of Search ..... 224/222, 219, 224/660, 663, 267, 232, 243, 246, 911, 602, 603, 625, 626; 602/27, 65; 2/311, 312, 239, 247, 240, 401, 403, 109, 404, 405, 316, 326, 331; 150/131, 132, 139, 143, 145, 147, 118, 150; 313/59

[56] References Cited

U.S. PATENT DOCUMENTS

| | | | |
|---|---|---|---|
| 1,184,311 | 5/1916 | Boch | 224/222 |
| 1,287,875 | 12/1918 | Careless | 224/222 |
| 1,445,528 | 2/1923 | Marsh | 224/222 |
| 2,779,370 | 1/1957 | Wittenberg | 383/59 |
| 2,962,070 | 11/1960 | Towles | 383/59 |
| 3,797,715 | 3/1974 | Scialdone | 224/587 |
| 5,215,379 | 6/1993 | Pickard et al. | 224/222 |
| 5,540,366 | 7/1996 | Coomber | 383/59 |

FOREIGN PATENT DOCUMENTS

| | | | |
|---|---|---|---|
| 72856 | 10/1945 | Norway | 224/222 |

*Primary Examiner*—Gregory M. Vidovich
*Assistant Examiner*—Maerena W. Brevaro

[57] ABSTRACT

An ankle pouch that can be worn either under one's clothing, or can be worn in conjunction with evening wear or formal wear. The pouch has elastic gathers which snugly hold the pouch in place to one's arm or leg area Another embodiment of the pouch has a water-tight compartment for protecting articles while swimming. Located along the flap, which covers the mouth opening of the pouch, is a translucent pocket for displaying information in case of an emergency, such as instructions on dispensing the medication located within the pouch. In situations where one is jogging, the pouch is slipped over the wrist with an arching strap inserted between the fingers of the hand. The pouch has many other uses, such as carrying pepper spray or pagers.

2 Claims, 2 Drawing Sheets

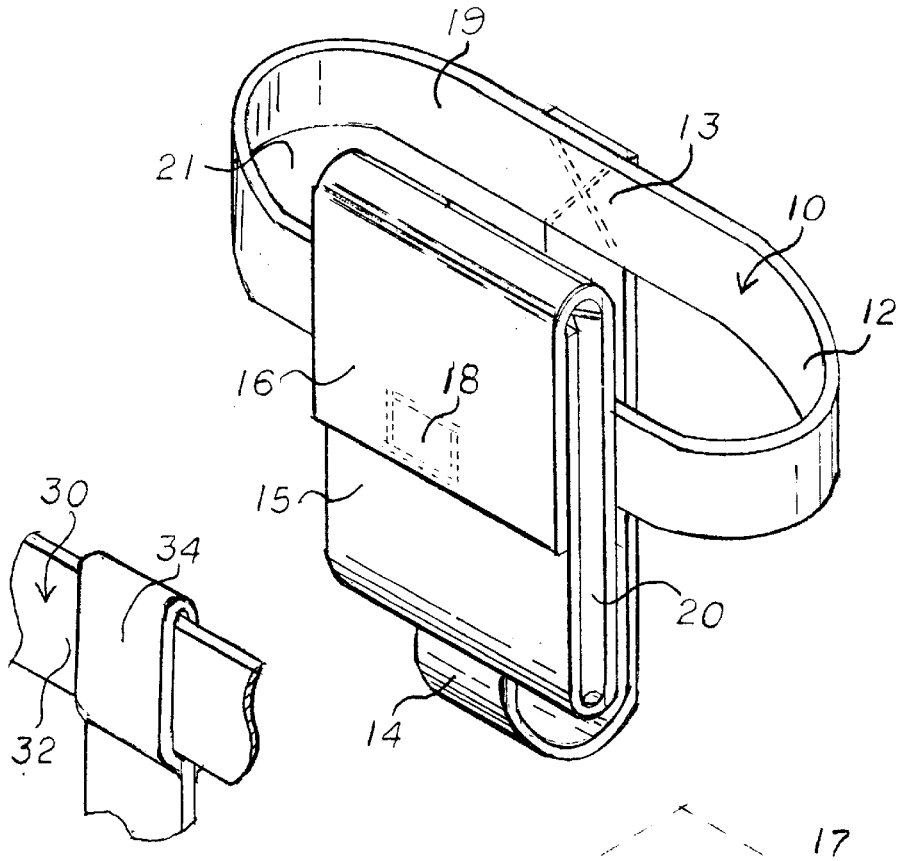
Fig. 1.
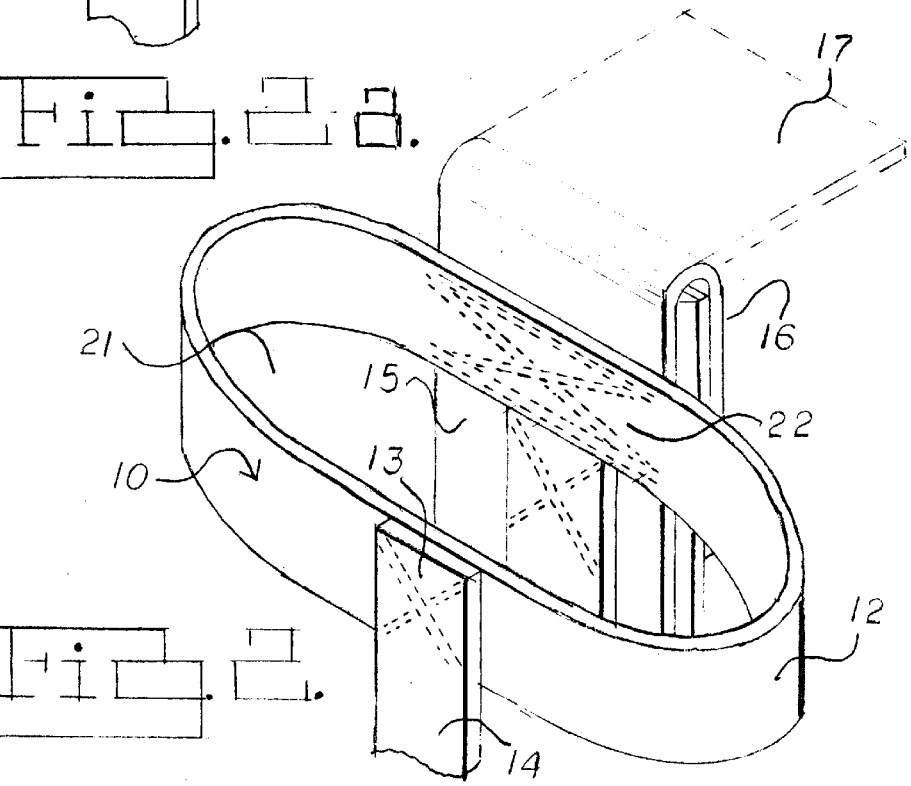
Fig. 2.
Fig. 3.

MULTIPLE PURPOSE ANKLE POUCH

TECHNICAL FIELD

The following invention relates in general to personal storage compartments, and more particularly to those storage compartments carried on ones person.

BACKGROUND OF THE INVENTION

Until the present invention, people were always limited with the various places on one's person where personal objects could be stowed. Some of these places include a pants pocket or a purse. However adequate for most situations, there are inherent problems with the limitations of carrying articles in a purse, wallet or even loosely in a pocket.

Some of these limitations include safety. In situations where one is targeted for theft, the first place a thief checks is a purse, wallet or pocket. Another limitation is fashion. In many situations, where ones attire requires the non use of a wallet or hand bag, one is limited in the ability to carry personal objects, such as money, credit cards or identification.

In still another situation where one is limited is while partaking in various athletic or sporting events where you cannot carry a purse or where your clothing doesn't have pockets. In situations where one is simply attending a sporting event as a spectator, it is cumbersome to carry a hand bag.

Admittedly, there are various storage pouches and bags which overcome these problems. However, in doing so they create new problems of their own. For example, a money belt can hold a few items while strapped to ones waist. This particular item again limits one's ability to wear various fashions or participate in sports. Another item meant to overcome the above is the waist pouch which is secured to a hook and loom fastening belt which is then secured over one's clothing. Again one is limited by fashion, athelics and safety as these pouches become a target for thieves.

In light of these problems, it is the object of the present invention to provide a storage pouch for deployment on one's person to where one can place personal items while concealing the pouch from view.

It is another object of the present invention to provide a pouch for use on one's person which can be used by men or women and can be fabricated from various fabrics and materials and coordinated with one's apparel.

While it is still the further object of the present invention to provide a pouch for attachment to one's person for use during one's occupation where concealment of certain objects is desirous, such as a badge for an undercover cop, or pepper spray, or tear gas for a postman, or even pepper spray for women.

It is still a further object of the present invention to provide a pouch for use on one's person which is water-tight and can keep valuables safe and dry while one is swimming, or keep one's medication dry and at hand.

SUMMARY OF THE INVENTION

In light of the foregoing problems, and to fulfill the above-stated objects, there is provided a stowage pouch for deployment on one's person. In a main embodiment of the present invention, the pouch is adapted for use with one's ankle. The pouch has a flap which is fastened over the mouth of the pouch and has an elastic strap which extends around the leg near the ankle, and has an under strap which extends from the pouch down around the arch of the foot and back to the ankle strap.

The pouch can range in size and can easily be adjusted depending upon market demand. Another embodiment of the present invention comprises a pouch having a flap portion which extends over the mouth of the pocket. The flap has an interior surface which has a hooking fastener patch while the exterior surface of the pocket has a loom fastener patch adapted for communication with the flap fastening patch thereby providing a secure enclosure for articles placed into the pouch. The pouch and straps can be fabricated from any number of materials well-suited for any given field of use. The straps for example can be made from leather, or a simulation, and can have a tension buckle for adjusting the fit to the user.

In still another embodiment of the present invention, the ankle pouch is comprised of a water-repelling material and has a mouth opening which has a series of grooves which interlock by deploying a zipper. This embodiment allows one to protect moisture sensitive objects such as matches or medication. This embodiment also has a flap which is extended over the mouth and zipper area and again has a hook and loom fastener. The flap protects the zipper from debris and other hazards which could affect the water sealing capabilities thereof. Located along the outer surface area of the flap is a small translucent pocket which is adapted to receive important information such as medical instructions for the medicine stowed in the pouch and for any additional information which may be deemed important to a care-giver in an emergency situation.

While the foregoing embodiments are well suited to achieve the above stated objects, those skilled in the art to which the present invention pertains, should realize that such embodiments are subject to modification, alteration and change without departing from the scope and spirit of the present invention. For example, the pouch can easily be slid onto the wrist with the strap encircling the wrist while the cross strap is placed between the fingers.

Other variations will no doubt occur to those skilled in the art upon the study of the detailed description and drawings contained herein. Accordingly, it is to be understood that the present invention is not limited to the specific embodiments described herein, but should be deemed to extend to the subject matter defined by the appended claims, including all fair equivalents thereof.

BRIEF DESCRIPTION OF THE DRAWINGS

In the drawings, where like reference numerals are used to indicate identical components in the various drawing figures;

FIG. 1 is a perspective view of a preferred embodiment of the present invention while in non usage mode.

FIG. 2 is a fragmentary perspective view of FIG. 1 as seen from the rear. Also depicted is the flap member.

FIG. 2*a* is a fragmentary perspective view, in partial cross-section, of another embodiment of the cross-strap wherein the strap is free-floating.

DETAILED DESCRIPTION OF THE EMBODIMENTS

Figure 3:
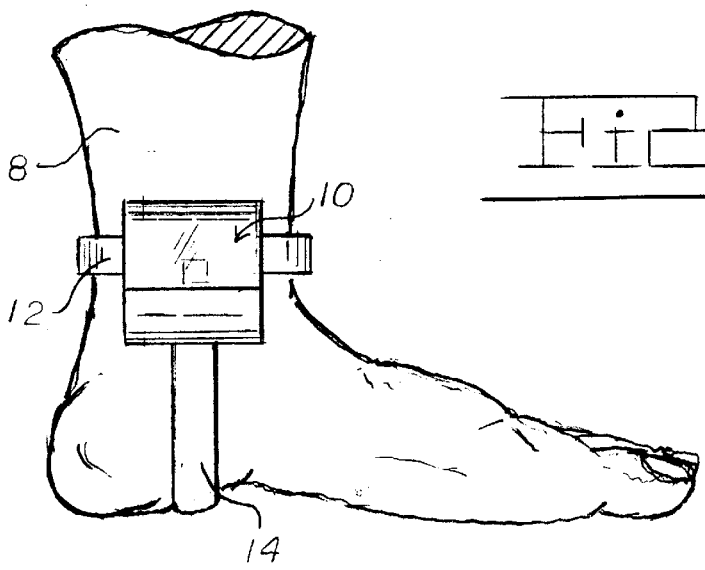
FIG. 3 is a fragmentary side elevation, in partial cross-section, of the preferred embodiment as reduced to practice.

With combined reference to all the embodiments, an ankle pouch is generally denoted by the numeral 10. As seen in FIG. 1, the ankle pouch 10 comprises an elastic leg band 12, a cross-arch strap 14 and a pouch member 15. The leg band 12 is fastened to the cross-arch strap 14 by the stitching 13. The pouch 15 has a flap 16 and a pocket 20 which is sealed off by the flap 16 which has a fastening means there fixed by stitching 18. The unitary strap 19 has an opening 21 for receiving a foot.

As seen in FIG. 2, the ankle pouch 10 again comprises an elastic leg band 12 and a cross-arch strap 14, which is fastened to the leg band 12 by means of stitching 13. Fixed to the leg band 12 and the cross-arch strap 14 by means of stitching 22 is the pouch 15 which has a flap 16, which is moveable as depicted by phantom lines 17. An opening 21 is adapted for receiving a foot.

FIG. 2*a* shows another embodiment 30 of the elastic leg band 32 adapted for communication with a free-floating cross-arch strap 34.

FIG. 3 shows the preferred embodiment 10 as held to a human foot 8 by means of an elastic leg band 12 and a cross-arch strap 14 for a reduction to practice of the preferred embodiment 10 of the present invention.

Figure 4:
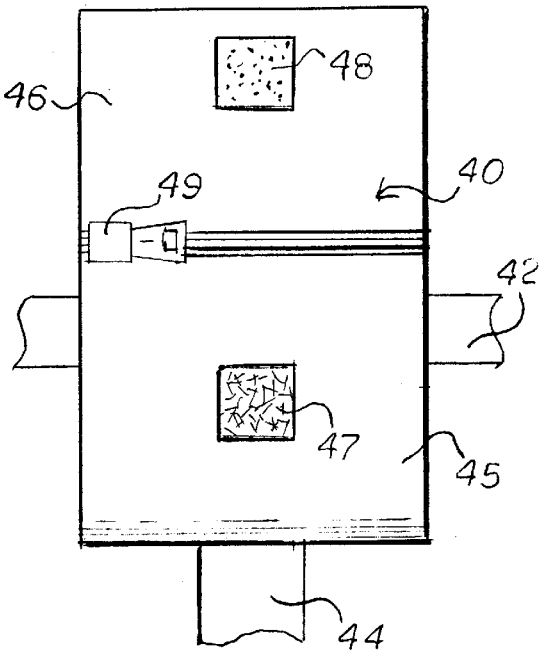
FIG. 4 is a fragmentary side elevation of another embodiment of FIG. 1, wherein the pouch is closed off by a water-tight zipper.

As seen in FIG. 4, another embodiment 40 comprises an elastic leg band 42, a cross-arch strap 44, and a pouch 45. Seen in an open position, the pouch 45 has a flap 46 extending from a water tight zipper 49. The flap 46 is fastened over the pouch 45 by hook and loom fasteners 47 and 48

Figure 5:
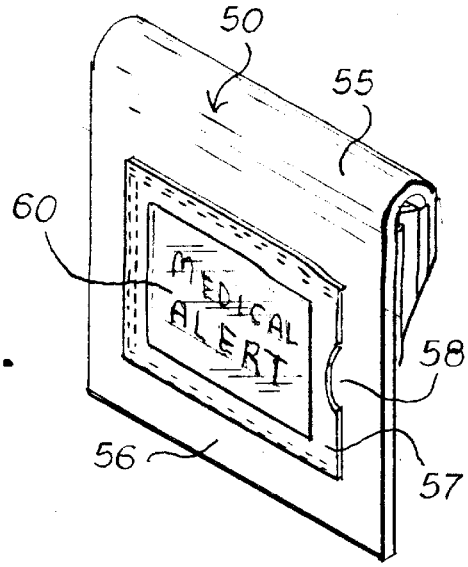
FIG. 5 is a fragmentary perspective view of yet another embodiment wherein an external pocket is displaced on the pouch flap and has a translucent surface for displaying information.

In FIG. 5, another embodiment 50 has a pouch 55 having a flap member 56. The flap member 56 has an external flap pocket 57 for receiving printed information through an opening 58 and displaying the printed information through a translucent covering 60.

What is claimed is:

1. A stowage compartment for use in containing personal articles on one's person, comprising;

a plurality of elastic retaining straps adapted for communication with an upper and lower human extremity, an expandable containment pouch having an opening for receiving the personal articles, the pouch further comprising a flap means for covering the opening and further having a fastening means for fixing the flap over the opening, and wherein the plurality of elastic retaining straps further comprise a first horizontal strap having a central opening at a terminal end and attachable to the pouch using stitching at the opposing terminal end, and a second vertically extended strap stitched to the horizontal strap at one terminal end and extending upward for stitched communication to the pouch at the opposing terminal end thereby forming a central elastic opening for biased communication with a human extremity.

2. The apparatus as described in claim 1, wherein said straps have a free-floating means for variable self-adjustment to any user.

* * * * *